US007029811B2

(12) United States Patent
Azuma et al.

(10) Patent No.: US 7,029,811 B2
(45) Date of Patent: Apr. 18, 2006

(54) ELECTROPHOTOGRAPHIC PHOTORECEPTOR

(75) Inventors: Jun Azuma, Osaka (JP); Eiichi Miyamoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 109 days.

(21) Appl. No.: 10/248,229

(22) Filed: Dec. 30, 2002

(65) Prior Publication Data

US 2004/0126140 A1 Jul. 1, 2004

(51) Int. Cl.
*G03G 5/10* (2006.01)

(52) U.S. Cl. ..... 430/69; 430/96; 430/59.1; 399/159

(58) Field of Classification Search ..... 430/69, 430/96, 59.1; 399/159
See application file for complete search history.

(56) References Cited

U.S. PATENT DOCUMENTS

| | | | | |
|---|---|---|---|---|
| 4,952,293 | A * | 8/1990 | Sypula et al. | 204/479 |
| 5,763,125 | A * | 6/1998 | Kawata | 430/59.6 |
| 6,221,547 | B1 * | 4/2001 | Iizuka et al. | 430/69 |
| 2003/0077441 | A1 * | 4/2003 | Kobayashi et al. | 428/349 |

FOREIGN PATENT DOCUMENTS

JP 4-240861 * 8/1992

* cited by examiner

*Primary Examiner*—John L Goodrow
(74) *Attorney, Agent, or Firm*—Shinjyu Global IP

(57) ABSTRACT

An electrophotographic photoreceptor is disclosed which includes a conductive resin substrate and a resin layer. The resin layer includes a binding resin and is formed on the conductive resin substrate. The difference between the solubility parameter of the conductive resin substrate and the solubility parameter of the resin layer of the photoreceptor is 2.5 $(J/cm^3)^{1/2}$ or less.

16 Claims, 1 Drawing Sheet

ELECTROPHOTOGRAPHIC PHOTORECEPTOR

BACKGROUND OF INVENTION

1. Field of the Invention

This invention generally relates to an electrophotographic photoreceptor and an image forming device that employs the same, such as laser printers, electrostatic copying machines, plain paper facsimile devices, and multi-function devices which combine all of these functions.

2. Background Information

A conventional image forming device electrostatically charges the surface of an electrophotographic photoreceptor, exposes an original document having an image thereon, and forms an electrostatic latent image on the electrophotographic photoreceptor that corresponds to the image on the original document. After developing the electrostatic latent image with toner, the image forming device transfers the toner formed on the electrophotographic photoreceptor to a recording medium such as paper. The recording medium is then separated from the electrophotographic photoreceptor, the toner thereon is fixed, and an image is formed thereon. After the toner is transferred to the recording medium, any remaining toner left on the surface of the electrophotographic photoreceptor is removed by a cleaning step as needed. The electrostatic charge is then removed from the surface of the electrophotographic photoreceptor, and the electrophotographic photoreceptor is then supplied with another electrostatic charge in order to form an image on another recording medium.

The photoreceptor is composed of a resin layer (e.g., a photosensitive layer and an intermediate layer) that is formed on the surface of an electroconductive substrate. The resin layer is formed on the surface of the electroconductive substrate by applying a liquid resin thereon that is obtained by dissolving a binding resin in an organic solvent. A metal tube composed of aluminum or an aluminum alloy is generally used for the electroconductive substrate, which has excellent heat resistance and is comparatively lightweight.

However, when the resin layer is applied to the surface of an aluminum or aluminum alloy substrate, the thickness of the resin layer will be irregular because the adhesiveness of the liquid resin to the substrate is low, and therefore an irregular image will be transferred to a recording medium. In addition, although this type of substrate is lighter than other metal substrates, large size substrates will be correspondingly heavy, and thus a large amount of torque will be required to drive them.

Furthermore, when the aforementioned materials are used as is in the aforementioned conventional substrate, a charge that is higher than necessary will be placed on the resin layer because these materials have an extremely high conductivity. Thus, the surface potential of the photoreceptor will decline, and a foggy and low density image will be produced. In order to prevent this defect from occurring, others have previously proposed forming an alumite layer on the surface of the substrate. However, this increases the cost of the electrophotographic photoreceptor.

In addition, a method of preventing a charge that is greater than necessary from being placed on the resin layer has been proposed in which the alumite layer is replaced with an intermediate layer that is primarily composed of a resin and formed on the surface of the substrate. By including a pigment in the intermediate layer, the light used during exposure will normally be absorbed by the pigment and not be reflected by the surface of the substrate, and thus preventing interference fringes. However, the materials that can be used as a pigment are limited to metal oxides with low conductivity such as titanium oxide and the like because of the need to preserve a certain degree of insulation in the intermediate layer.

In view of the above, there is a need for a substrate for an electrophotographic photoreceptor which overcomes the above mentioned problems in the prior art. This invention addresses this need in the prior art as well as other needs, which will become apparent to those skilled in the art from this disclosure.

SUMMARY OF INVENTION

It is an object of the present invention to reduce the weight of a substrate for an electrophotographic photoreceptor, reduce the cost thereof, and to produce images that have excellent quality and no irregularities.

An electrophotographic photoreceptor according to a first embodiment of the present invention is comprised of a conductive resin substrate and a resin layer. The resin layer includes a binding resin, and is formed on the conductive resin substrate. The difference between the solubility parameter of the conductive resin substrate and the solubility parameter of the resin layer is 2.5 $(J/cm^3)^{1/2}$ or less.

In addition, an electrophotographic photoreceptor according to a second embodiment of the present invention is comprised of a conductive resin substrate and a resin layer. The conductive resin substrate includes one or more resins selected from a first group consisting of a polyamide resin, a polyvinyl butyral resin, and a polyester resin. The resin layer includes one or more resins selected from a second group consisting of a polycarbonate resin, a polyamide resin, a polyvinyl butyral resin, and a polyester resin. The difference between the solubility parameter of the resin selected from the first group and the solubility parameter of the resin selected from the second group is 2.5 $(J/cm^3)^{1/2}$ or less.

With the photoreceptors of the first and second embodiments, the wettability of the liquid resin that is used to form the resin layer is excellent, and thus the difference between the solubility parameter of the conductive resin substrate and the sulubility parameter of the resin layer is as defined above. Because of this, a resin layer having excellent adhesion and a uniform thickness can be formed on the substrate. In addition, because the conductivity of the conductive resin substrate is not as high as a metal substrate, a charge that is higher than necessary will not travel from the substrate to the resin layer.

The electrophotographic photoreceptor according to the first and second embodiments of the present invention may also include the following features:

1. The conductive resin substrate can have a solubility parameter of 22 $(J/cm^3)^{1/2}$ or greater.

In this situation, the conductive resin substrate will have a high polarity, and thus there will be a small difference between the solubility parameter of the conductive resin substrate and the solubility parameter of the resin layer. In addition, the resin layer will have an even higher degree of adhesiveness to the conductive resin substrate.

2. The resin layer can further include a charge generating agent and/or a charge transport agent.

In this situation, it is not necessary to provide an insulating layer or the like on the surface of the substrate, which thereby lowers costs, because a photosensitive layer composed of a charge generation layer that includes a binding resin and a charge generating agent, a charge transport layer that includes a binding resin and a charge transport agent, or a photoconductive layer that includes a binding resin, a charge generating agent, and a charge transport agent can be formed directly on the conductive resin substrate.

3. The resin layer can further include a pigment.

In this situation, the pigment can be freely selected in accordance with its conductivity because the substrate of the photoreceptor of the present invention is composed of a conductive resin.

4. The conductive resin substrate can include a conductive filler.

In this situation, the conductivity of the conductive resin substrate can be easily and minutely adjusted by adjusting the shape, size, and distribution of the conductive filler.

Moreover, an image forming device of the present invention is comprised of the electrophotographic photoreceptor of the first or second embodiments, a drive means that drives the photoreceptor in a fixed direction, and an image forming unit (e.g., a charging means, exposure means, developing means, transfer means, etc.) that is disposed around the photoreceptor.

In this image forming device, a conductive resin substrate is used as the substrate for the electrophotographic photoreceptor, and thus it is lighter than a substrate made of aluminum. Because of this, the drive torque of the electrophotographic photoreceptor can be reduced, thereby allowing the output from the drive means to be reduced.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF DRAWINGS

Referring now to the attached drawing which forms a part of this original disclosure.

DETAILED DESCRIPTION

1. Electrophotographic photoreceptor

Figure 1:
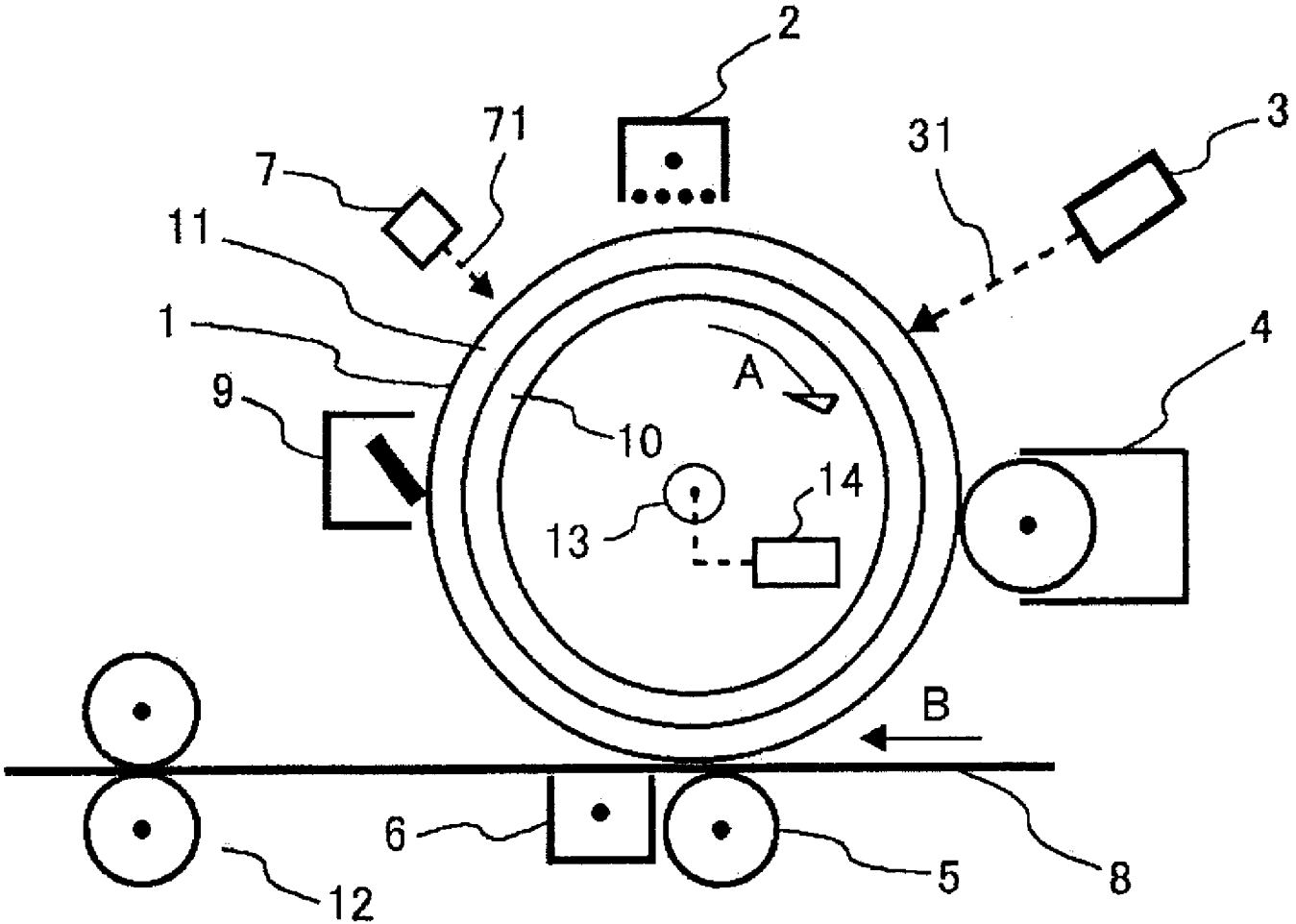
FIG. 1 is a longitudinal section showing an image forming device in which an embodiment of the present invention has been adopted.

The electrophotographic photoreceptor of the present invention is comprised of a conductive resin substrate and a resin layer (a photosensitive layer and an intermediate layer) provided on top on the conductive resin substrate.

a. Structure of the Conductive Resin Substrate

The conductive resin substrate of the electrophotographic photoreceptor of the present invention is a sheet, belt, or drum-shaped substrate that is conductive and composed primarily of resin. This resin can be made conductive by using a conductive resin, by including a conductive filler in the resin, or by depositing a metal or a metal oxide on the surface of the resin substrate.

The resin used in the conductive resin substrate should be dimensionally accurate when the substrate is molded, should be resistant to the solvents in the liquid resin used to form the resin layer, should be dry after the resin layer is formed, should have sufficient thermostability to prevent deformation and disintegration during heat processing, and should have sufficient mechanical strength to prevent problems from occurring during the image formation process.

Examples of resins that fulfill these requirements include, but are not limited to, thermoplastic resins such as polyamide resins (Nylon 6, Nylon 66, Nylon-MXD6, Nylon 8, etc.), polyvinyl butyral resins, polyester resins (polyethylene terephthalate, polybutylene terephthalate, polyethylene naphthalate, etc.), styrene polymer resins, acrylic polymer resins (polymethyl acrylate, polymethyl methacrylate, polyacrylonitrile, etc.), polypropylene resins, polyethylene resins, chlorinated polyethylene, polyvinyl chloride, polycarbonate, polyacetal, polyimide, polyether (polyoxymethylene, polyphenylene oxide, etc.), polysulfone, polyphthalamide, polyethylene fluoride, polyphenylene sulfide, polyalylate, ketone resins, polyethersulfone, polymethylpentene, and polynorbornene, thermosetting resins having the ability to crosslink, such as epoxy resins, silicone resins, phenol resins, urea resins, melamine resins, unsaturated polyester resins, polyurethane, polyaniline, alkyd resins, and diallyl phthalate resins, photocurable resins such as epoxy acrylate and urethane acrylate, fluoride resins such as polytetrafluoroethylene and polychloro-trifluoroethylene, and conductive resins such as polypyrrole, polyacetylene, polyparaphenylene, polythiophene, polyfuran, and polyphenylenevinylene. In addition, it is also possible to use copolymers composed of monomers of the aforementioned resins or copolymers composed of monomers of the aforementioned resins and monomers of other polymers, such as styrene-acrylic copolymer, styrene-butadiene copolymer, styrene-acrylonitrile copolymer, styrene-butadiene-acrylonitrile copolymer, styrene-maleate copolymer, ethylene-vinyl acetate copolymer, vinyl chloride-vinyl acetate copolymer, and ester-urethane copolymer.

Each of these resins not only may be used individually, but two or more types may also be used together as a polymer alloy or the like.

Amongst the aforementioned resins, the polyamide and polyester resins have superior heat resistance, mechanical strength, and resistance to solvents, and the polyvinyl butyral resins have superior mechanical strength and adhesiveness, and thus these resins (hereinafter collectively referred to as the first group) are preferably included in the conductive resin substrate.

Examples of conductive fillers include, but are not limited to, carbon black (thermal black, acetylene black, furnace black, channel black, lamp black, graphite, etc.), metals (aluminum, copper, nickel, conductive glass powder, tin oxide, antimony oxide, gold, silver, etc.), inorganic compounds (zinc oxide, titanium oxide, alumina, calcium carbonate, barium sulphate, mica, potassium titanate, aluminum borate, silicon carbide, indium oxide) doped with a conductive material (such as antimony oxide), or an inorganic compound coated with conductive materials (such as tin oxide doped with antimony oxide or indium oxide doped with antimony oxide).

The conductive filler may be shaped into spheres, rods, needles or spindles. Conductive filler shaped into rods, needles or spindles can be placed close to one another, thus allowing an electric circuit to be completed without using a great deal of resin having a high electrical resistance, and allowing the efficient movement of an electrical charge therein. Preferably, the primary particles of a conductive filler shaped into rods, needles or spindles have an volume mean particle diameter of between 0.01 microns and 0.5 microns, and a length of 100 microns or less. In addition, a conductive filler shaped into spheres is more dispersible in a binding resin than a conductive filler shaped into rods, needles or spindles, and thus production efficiency can be improved and the electrical characteristics of an intermediate layer can be made more uniform. Preferably, the spherically shaped conductive filler is an oxygen-containing metallic compound in which the volume mean particle diameter of the primary particles is between 0.01 microns and 0.2 microns.

The volume resistivity of the conductive resin substrate may be between approximately $10^{-3}$ and $10^{10}$ ohm-cm, but in order to allow an electric charge to efficiently flow from the photosensitive layer to ground, it is preferably $10^{6}$ ohm-cm or less and more preferably $10^{4}$ ohm-cm or less. In addition, in order to efficiently prevent an electric charge that is greater than necessary from being placed on the photosensitive layer, the volume resistivity is preferably $10^{-1}$ ohm-cm or greater and more preferably 1 ohm-cm or greater.

The conductive resin substrate may also include reinforcing materials (such as glass fibers, carbon fibers, glass beads, and molybdenum disulfide) in order to improve its mechanical strength, a dispersing agent (such as magnesium sulphate, talc, silica, titanium oxide, potassium titanate, calcium silicate, calcium carbonate, barium sulphate, zinc oxide, and clay) in order to improve the dispersibility of the conductive filler, and a filler such as a coloring agent (organic/inorganic pigment) in order to prevent the reflection and transmission of light.

b. Production of the Conductive Resin Substrate

The conductive resin substrate can be produced with molding techniques known in the prior art, e.g., injection molding, blow molding, transfer molding, compression molding, and the like. Note that when a conductive filler, reinforcing material, a dispersing agent, or a coloring agent is to be included in the conductive resin substrate, it may be molded after the resin that makes up the substrate is mixed or kneaded together with these additional materials with a mixer or kneader.

When a conductive filler is to be included in the conductive resin substrate, a preferred ratio is 1 to 50 parts by weight of conductive filler per 100 parts by weight of the resin that makes up the substrate, and more preferably, 10 to 30 parts by weight per 100 parts by weight of resin.

c. Structure of the Resin Layer

The resin layer of the electrophotographic photoreceptor of the present invention is formed on the surface of the conductive resin substrate, and employs a single binding resin or a binding resin that includes additives. These additives include, but are not limited to, a charge generating agent, a charge transport agent (such as a hole transport agent and an electron transport agent), and a pigment, and depending upon the types of additives used, can provide a variety of functions to the resin layer.

For example, a charge generating layer can be formed by including a charge generating agent in the resin, and a laminated photoreceptor can be obtained by further providing a charge transport layer on top of this layer. In addition, a charge transport layer can be formed by including a charge transport agent in the resin layer, and a laminated photoreceptor having a polarity opposite that of the aforementioned laminated photoreceptor can be obtained by further providing a charge generating later on top of this layer. Moreover, when both a charge generating agent and a charge transport agent are included in the resin layer, a single layer photoreceptor can be obtained because a photoconductive layer in which both charge generation and charge transport occurs can be formed thereby.

In addition, an intermediate layer can be formed by including a single binding resin or a pigment in a binding resin in the resin layer. In the electrophotographic photoreceptor of the present invention, this intermediate layer is not necessarily required because the conductivity of the conductive resin substrate is already regulated. However, an intermediate layer may be provided in order to more finely regulate the conductivity of the photoreceptor or prevent buffer bands.

Examples of binding resins include, but are not limited to, thermoplastic resins such as styrene polymers, styrene-butadiene copolymers, styrene-acrylonitrile copolymers, styrene-maleate copolymers, acrylic polymers, styrene-acrylic copolymers, polyethylene, ethylene-vinyl acetate copolymers, chlorinated polyethylene, polyvinyl chloride, polypropylene, vinyl chloride-vinyl acetate copolymers, polyester, polyamide, polycarbonate, polyalylate, polysulfone, diallyl phthalate resins, ketone resins, polyvinyl butyral resins, and polyether resins, thermosetting resins having the ability to cross-link, such as silicone resins, epoxy resins, phenol resins, urea resins, melamine resins, unsaturated polyester, alkyd resins, and polyurethane, and photocurable resins such as epoxy acrylate and urethane acrylate. Each of these resins may not only be used individually, but two or more types may also be used together.

As noted above, it is preferable that the first group of resins be included in the conductive resin substrate. However, the binding resins that match particularly well with the resins of the first group and which have good compatibility with charge transport agents, charge generating agents, and pigments are polycarbonate, polyamide, polyvinyl butyral, and polyester (hereinafter collectively referred to as the "second group").

Examples of the charge generating agents added to the resin layer include, but are not limited to, inorganic photoconducting powders such as amorphous inorganic materials (e.g., a-silicon, a-carbon, etc.), and a variety of pigments well known in the prior art, such as metal-free phthalocyanine, phthalocyanine pigment which includes a variety of crystal systems of phthalocyanine that are coordinated by metals (e.g., titanium, copper, aluminum, iron, cobalt, nickel, indium, gallium, tin, zinc, vanadium, etc.) or metal oxide compounds (oxides of the aforementioned metals such as titanium oxide), azo pigments, bisazo pigments, perylene pigments, anthanthrone pigments, indigo pigments, triphenylmethane pigments, indanthrene pigments, toluidine pigments, pyrazoline pigments, quinacrine pigments, and dithioketopyrrolopyrrole pigments.

Each of these charge generating agents makes the photosensitive layer sensitive to the wavelength region of the exposure light. In addition, they may be used individually, or two or more types may be used in combination.

Specific examples of the charge transport agents added to the resin layer include, but are not limited to, hole transport agents well known in the prior art such as benzidine compounds, phenylenediamine compounds, naphthylenediamine compounds, phenanthrenediamine compounds, oxidiazole compounds (e.g., 2,5-di (4-methylaminophenyl)-1,3,4-oxadiazole), styryl compounds (e.g., 9-(4-diethylaminostyryl) anthracene), carbazole compounds (e.g., poly-N-vinyl carbozole, pyrazoline compounds (e.g., 1-phenyl-3-(p-dimethylaminophenyl) pyrazoline), hydrazone compounds (e.g., diethylaminobenzaldehyde diphenylhydrazone), triphenylamine compounds, indole compounds, oxozole compounds, isoxazole compounds, thiozole compounds, triazol compounds, butadiene compounds, pyrene-hydrazone compounds, acrolein compounds, carbazole-hydrazone compounds, quinoline-hydrazone compounds, stilbene compounds, stilbene-hydrazone compounds, diphenylenediamine compounds, and organic polysilane compounds, and electron transport agents well known in the prior art such as benzoquinone compounds, naphthoquinone compounds, malononitrile, thiopyran compounds, tetracyanoethylene, 2,4,8-trinitrothioxanthone, fluorenone (e.g., 2,4,7-trinitro-9-fluorenone), dinitrobenzene, dinitroanthracene, dinitroacridine, nitroanthracene, anhydrous succinic anhydride, maleic anhydride, dibromomaleate, 2,4,7-trinitrofluorenoneimine compounds, ethylated nitrofluorenoneimine compounds, toryptanthorinecompounds, toryptanthorineimine compounds, azafluorenone compounds, dinitropyridoquinazoline compounds, thiozanthene compounds, 2-phenyl-1,4-naphthoquinone compounds, 5,12-naphthacenequinone compounds, α-cyanostilbene compounds, 4"-nitrostilbene compounds, and benzoquinone compounds, as well as anions, cations and salts thereof.

These charge transport agents may be used individually or two or more may be used in combination.

The pigment included in the resin layer is a coloring agent that is different from the aforementioned pigments used as charge generating agents, and a variety of organic and inorganic colors and dyes can be employed. Specifically, this pigment can be selected from the aforementioned conductive fillers, reinforcing materials, and dispersing agents, as well as from the pigments listed in the reference manual Kagaku Benran Ouyouhen (3rd Edition, pp. 977–1027) that absorb light in the wavelengths generated by the exposure light.

A variety of other components may be added to the resin layer, including for example fluorene compounds, ultraviolet stabilizers, plasticizers, surface active agents, leveling agents, and the like. In addition, a sensitizing agent such as terphenyl, halonaphthoquinone, or acenaphthylene may also be added to the resin layer in order improve the sensitivity of the photoreceptor.

d. Production of the Resin Layer

When the resin layer is to be a photoconductive layer, it is preferred that 0.1 to 50 parts by weight, and more preferably 0.5 to 30 parts by weight, of a charge generating agent be added to each 100 parts by weight of the binding resin. In addition, it is preferred that 5 to 500 parts by weight, and more preferably 25 to 200 parts by weight, of a hole transport agent be added to each 100 parts by weight of the binding resin. Furthermore, it is preferred that 5 to 100 parts by weight, and more preferably 10 to 80 parts by weight, of an electron transport agent be added to each 100 parts by weight of the binding resin.

In this case, the total weight of the hole transport agent and the electron transport agent used is preferably 20 to 500 parts by weight, and more preferably 30 to 200 parts by weight, for each 100 parts by weight of the binding resin.

When the resin layer is to be a charge generating layer, it is preferred that 5 to 1000 parts by weight, and more preferably 30 to 500 parts by weight, of a charge generating agent be added to each 100 parts by weight of the binding resin. In addition, it is preferred that 1 to 200 parts by weight, and more preferably 5 to 100 parts by weight, of a hole transport agent be added to each 100 parts by weight of the binding resin. Furthermore, when an electron transport agent is to be added, it is preferred that 1 to 200 parts by weight, and more preferably 5 to 100 parts by weight, thereof be added to each 100 parts by weight of the binding resin.

When the resin layer is to be a charge transport layer, and a hole transport agent is to be added, it is preferred that 10 to 500 parts by weight, and more preferably 25 to 200 parts by weight, thereof be added to each 100 parts by weight of the binding resin. In addition, when an electron transport agent is to be added, it is preferred that 0.1 to 250 parts by weight, and more preferably 0.5 to 150 parts by weight, thereof be added to each 100 parts by weight of the binding resin.

When the resin layer is to be an intermediate layer, and a pigment is to be added, it is preferred that 5 to 500 parts by weight, and more preferably 20 to 250 parts by weight, thereof be added to each 100 parts by weight of the binding resin.

The binding resin used in the intermediate layer of the electrophotographic photoreceptor of the present invention is primarily composed of a thermosetting resin. When a pigment is to be added to the intermediate layer, it is preferred that 5 to 500 parts by weight, and more preferably 20 to 250 parts by weight, thereof be added to each 100 parts by weight of the binding resin. In addition, the thickness of the intermediate layer is 0.1 to 50 microns, preferably 0.5 to 30 microns.

When the resin layer is to be a photoconductive layer, it is preferable that its thickness be 5 to 100 microns, and more preferably 10 to 50 microns. When the resin layer is to be a charge generating layer, it is preferable that its thickness be 0.01 to 5 microns, and more preferably 0.1 to 3 microns. When the resin layer is to be a charge transport layer, it is preferable that its thickness be 2 to 100 microns, and more preferably 5 to 50 microns. When the resin layer is to be an intermediate layer, it is preferable that its thickness be 0.1 to 50 microns, and more preferably 0.5 to 30 microns.

When a photoconductive layer is formed as a resin layer, a single layer photosensitive layer will be obtained. Thus, when a charge generating layer or a charge transport layer is formed as a resin layer on this photoconductive layer, a laminated photosensitive layer will be obtained. Here, a charge generating layer or a charge transport layer can be formed in a manner identical with that of the photoconductive layer. In addition, when a laminated photosensitive layer that further includes a charge generating layer or a charge transport layer is produced as a resin layer, it is possible to form an additional charge generating layer or a charge transport layer on top of the existing charge generating layer or charge transport layer in a manner identical with that described above. With a resin layer that includes an intermediate layer, it is possible to form a single photosensitive layer or a laminated photosensitive layer on the intermediate layer in a manner identical with that described above.

The resin layer may be formed by using a method in which a liquid resin is applied to the substrate. In this method, a charge generating agent, a charge transport agent, and/or a pigment noted above will be added to one of the organic solvents noted below such as tetrahydrofuran or the like, these ingredients will be dispersion mixed with a method known in the prior art, such as with a roll mill, a ball mill, an Attria mixer, a paint shaker, or an ultrasonic distributor, and a liquid resin will be prepared. A resin layer can be formed by applying and drying this liquid resin by using means known in the prior art.

Examples of organic solvents that can be used to produce the liquid resin include, but are not limited to, alcohols such as methanol, ethanol, isopropanol, and butanol, aliphatic hydrocarbons such as n-hexane, octane, and cyclohexane, aromatic hydrocarbons such as benzene, toluene, and xylene, halogenated hydrocarbons such as dichloromethane, dichloroethane, carbon tetrachloride, and chlorobenzene, ethers such as dimethyl ether, diethyl ether, tetrahydrofuran, 1,4-dioxane, ethylene glycol dimethyl ether, and diethylene glycol dimethyl ether, ketones such as acetone, methyl ethyl ketone, and cyclohexanone, esters such as ethyl acetate and methyl acetate, dimethylformaldehyde, dimethylformamide, and dimethylsulfoxide, and can be used individually or in combinations of two or more.

In addition, a surface active agent and/or a leveling agent can be added to the liquid resin in order to make the charge transport agent and/or the charge generating agent more dispersible and to make the surface of the photosensitive layer more smooth.

e. Solubility Parameter

The solubility parameter indicates the degree of chemical compatibility between two materials, and is calculated in the present invention by means of the method disclosed in the publication titled "A Method for Estimating Both the Solubility Parameters and Molar Volumes of Liquid" authored by Robert F. Fedors and found in the publication Polymer Engineering and Science, Vol. 14, No. 2, pp.147 to 154 (February 1974). If the conductive resin substrate and the resin layer are selected as examples, the solubility parameter indicates the degree of adhesiveness of the resin layer to the conductive resin substrate, and the smaller the difference between the solubility parameter of the conductive resin substrate and the solubility parameter of the resin layer is, the better this adhesiveness will be.

In the electrophotographic photoreceptor of the present invention, the difference between the solubility parameter of the conductive resin substrate and the solubility parameter of the resin layer is 2.5 $(J/cm^3)^{1/2}$ or less. When the difference between these solubility parameters is within this range, the adhesiveness of the resin layer to the conductive resin substrate will be excellent, and a uniform film thickness can be formed. However, when the difference between these solubility parameters is greater than 2.5 $(J/cm^3)^{1/2}$, the resin layer will have a low level of adhesiveness, the thickness of the film will not be uniform, and the film will delaminate.

The approximate solubility parameters of the primary resins that can be used in the conductive resin substrate and the resin layer are shown in Table 1.

| Resin | Solubility Parameter $(J/cm^3)^{1/2}$ |
|---|---|
| Nylon 8 | 26.0 |
| Nylon 66 | 27.9 |
| Polyvinyl butyral | 23.6 |
| Polyethylene terephthalate | 21.9 |
| Polycarbonate | 21.9 |
| Polystyrene | 19.9 |
| Polyacrylonitrile | 29.1 |
| Polymethyl acrylate | 19.9 |
| Polymethyl methacrylate | 19.5 |
| Polytetrafluoroethylene | 12.7 |
| Polyethylene | 16.8 |
| Polypropylene | 18.9 |
| Polyvinyl chloride | 19.7 |
| Polyvinyl acetate | 20.3 |
| Silicone resin | 15.6 |
| Epoxy resin | 20.7 |
| Urethane resin | 20.5 |
| Phenol resin | 17.4 |

In the electrophotographic photoreceptor of the present invention, it is preferred that the solubility parameters of both the conductive resin substrate and the resin layer be carefully measured when the difference between these solubility parameters is determined. However, the electrophotographic photoreceptor can be designed by selecting a combination of resins from amongst those listed in Table 1 in which the difference in their solubility parameters is 2.5 $(J/cm^3)^{1/2}$ or less. When two or more types of resin are to be used together for the conductive resin substrate or the resin layer, the solubility parameter of the whole can be easily determined by means of the weight average of the solubility parameters of these resins.

When the conductive resin substrate has a high polarity and has a solubility parameter of 22 $(J/cm^3)^{1/2}$ or greater, the adhesiveness of the resin layer will be even better and will be even more effective in providing a uniform film thickness.

It was noted above that the resins used in the conductive resin substrate are preferably those in the first group (polyamide, polyvinyl butyral, and polyester). These resins have solubility parameters of 22 $(J/cm^3)^{1/2}$ or greater, and have excellent adhesiveness. In addition, the binding resins of the second group (polycarbonate, polyamide, polyvinyl butyral, and polyester) have solubility parameters that are 20 $(J/cm^3)^{1/2}$ or greater. A combination of resins from the first group and the second group have extremely good adhesiveness. Thus, the adhesiveness of the resin layer can be effectively increased by respectively including a resin from the first group and a binding resin from the second group in the conductive resin substrate and the resin layer.

2. Image Forming Device

An image forming device in which an embodiment of the present invention is used is schematically shown in FIG. 1.

This image forming device is comprised of an electrophotographic photoreceptor 1. A central axis 13 of the electrophotographic photoreceptor 1 is connected thereto via a driver 14 and gears and pulleys (not shown in the FIGURE), and rotates at a constant speed in one direction (the direction of the arrow A).

In the present invention, the drive torque can be reduced to a low level because a conductive resin substrate is used as the substrate 10 of the photoreceptor, and thus the size of the motor used in the driver 14 can be reduced as well as the amount of power consumed thereby.

The electrophotographic photoreceptor 1 is formed by placing a resin layer 11 on top of the substrate 10. The resin layer 11 is formed from an intermediate layer provided on top of the conductive resin substrate, and a functional layer (charge generating layer, charge transport layer, photosensitive layer, etc.) provided according to need on top of the intermediate layer.

A main charging device 2, an exposure device 3, a developing device 4, a transfer device 5, a cleaning device 9, and a charge removal device 7 are provided in this sequence around the circumference of the photoreceptor 1 in the direction in which it is rotated. A separation device 6 and a fixing device 12 are provided downstream from the direction (the direction of the arrow B) that a transfer medium 8 is transported. Note that when image formation occurs in a system in which no cleaning is needed or one in which the charge on the photoreceptor is not removed, an image forming device will be used in which the aforementioned cleaning device 9 and/or the charge removal device 7 will be omitted.

When an image is formed by means of this image forming device, the surface of the photoreceptor 1 will be uniformly charged by means of the main charging device 2. Next, the surface of the photoreceptor 1 will be exposed along an exposure axis 31 by means of the exposure device 3, and an electrostatic latent image that corresponds to an original image will be formed on the surface of the photoreceptor 1. Afterward, the portion of the photoreceptor 1 that corresponds to the electrostatic latent image will be developed with toner by the developing device 4. Then, the toner image on the surface of the photoreceptor 1 will be transferred, by means of the transfer device 5, to the top of the transfer medium 8 that is transported thereto (in the direction of the arrow B). After transfer, the transfer medium 8 will be separated from the photoreceptor 1 by the separation device 6, and then the toner will be fixed by means of the fixing device 12.

After transfer, the toner remaining on the surface of the photoreceptor 1 that was not transferred to the transfer medium 8 will be removed by the cleaning device 9, After that, the charge on the surface of the photoreceptor 1 will be removed by the charge removing device 7, and will then be charged again by means of the main charging device 2.

The main charging device 2 can use charging methods that are well know in the art, such as by applying a high voltage to a charge wire that is provided adjacent to the surface of the photoreceptor 1 and conducting a corona discharge, or by contacting a charging member such as a conductive roller or a charging brush and the like to the surface of the photoreceptor 1 and applying a charge thereto. However, in order to maintain the surface potential of the photoreceptor 1 at a constant level, it is preferable to contact the surface of the photoreceptor 1 with a charging member, or provide a grid electrode between a charge wire on the main charging device 2 and the photoreceptor 1 and conducting a corona discharge.

The main charging voltage that is applied to the photoreceptor 1 from the charging device 2 will be different depending upon such things as the photoreceptor 1, the characteristics of the toner, and the developing conditions. However, when a standard positive charge type of photoreceptor is used, for example, it is preferable to set the main charging voltage such that the potential difference with respect to ground on the surface of the photoreceptor 1 is between +300 and +1000V.

The exposure device 3 will generally use a wavelength of laser light that the photoreceptor 1 is sensitive to. Specifically, a wavelength of light may be used that is absorbed by the charge generating agent. For example, the wavelength of laser light used will be 600 to 800 nm when phthalocyanine pigments are used as the charge generating agent, 400 to 600 nm for perylene pigments, and 600 to 700 nm for bisazo pigments.

Preferably, the amount of exposure will be set at a level in which the light potential is as low as possible. Specifically, it is preferred that the light potential of the photoreceptor 1 have the same polarity as the electric potential of the charged photoreceptor 1 with respect to ground, and that the amount of exposure is preferably set to 0 to 50V, and more preferably 0 to 10V.

Contact type or non-contact type developing devices known in the prior art can be used as the developing device 4, and either the dry or wet process may be used. The developing agent used in the developing device 4 may be either a one component system or two component system. When a carrier such as ferrite is used in the contact two component developing process, there will be times in which the surface of the photoreceptor will be scratched by the toner or carrier that comes into contact with the photoreceptor. However, even in this situation, it is possible to suppress any degradation in the image caused by the scratches by using the electrophotographic photoreceptor of the present invention.

Any contact transfer method or non-contact transfer method known in the prior art may be used in the transfer device 5. Specifically, the transfer voltage can be applied to the photoreceptor 1 via the transfer medium 8 by means of a charger, a roller, a brush, a plate, or the like.

Like with the charging device 2, a corona discharge by a charge wire, or a conductive roller, may be used as the separation device 6, with the use of a corona discharge being particularly preferred. The separation voltage applied to the photoreceptor 1 by the separation device 6 is generally alternating current.

The charge removal device 7 is not particularly necessary in the present invention, but well known prior art devices such as an LED array or a fluorescent tube can be used so long as the photoreceptor 1 is sensitive to the wavelength used, and the charge remaining on the surface of the photoreceptor 1 can be removed with a sufficient amount of light.

The cleaning device 9 can use a cleaning method known in the prior art, such as the blade method, the fur brush method, and the roller cleaning method, or any other simple and effective method of removing toner.

EXAMPLES

Examples of the present invention will be described below. Note that SP is defined herein as the solubility parameter, and Tg is defined herein as the glass transition point.

Example 1

100 parts by weight of Nylon 66 [SP=26.5 $(J/cm^3)^{1/2}$] were mixed together with 20 parts by weight of carbon black (particle size 30 nm) as conductive filler, and 15 parts by weight of calcium carbonate (particle size 2 nm) and 15 parts by weight of glass fiber (length 3 mm) as fillers, and a cylindrically shaped conductive resin substrate [SP=26.6 $(J/cm^3)^{1/2}$, volume resistivity=$3.2\times10^2$ ohm-cm] was produced by injection molding which had an outer circumference of 30 mm, a length of 320 mm, and a wall thickness of 2 mm.

Next, 5 parts by weight of X type metal-free phthalocyanine as a charge generating agent, 95 parts by weight of polyvinyl butyral and 5 parts by weight of polyethylene terephthalate resin as binding resins [SP=24.2 $(J/cm^3)^{1/2}$], 800 parts by weight of tetrahydrofuran as a dispersion agent, 60 parts by weight of 3,3"-dimethyl-N,N,N",N"-tetrakis (4-methylphenyl)-1,1"-biphenyl-4,4"-diamine as a hole transport agent, and 50 parts by weight of 3,5-dimethyl-3", 5"-ditert butyl-4,4"-diphenylquinone as an electron transport agent were mixed together and dispersed in a ball mill for 50 hours, and a liquid resin for a photoconductive layer was produced.

Afterward, the liquid resin was applied to the top of the conductive resin substrate, dried at 100 degrees centigrade for one hour, thereby forming a photoconductive layer [resin layer: SP=24.1 $(J/cm^3)^{1/2}$] with a thickness of 20 microns, and producing a single layer photoreceptor.

Example 2

A single layer photoreceptor according to Example 2 is identical to that produced in Example 1, except that Nylon 66 was replaced with Nylon 8 [SP=26.1 $(J/cm^3)^{1/2}$] to produce the conductive resin substrate [SP=26.0 $(J/cm^3)^{1/2}$, volume resistivity=$2.8\times10^2$ ohm-cm].

Example 3

A single layer photoreceptor according to Example 3 is identical to that produced in Example 1, except that the Nylon 66 was replaced with polyvinyl butyral [SP=24.3 $(J/cm^3)^{1/2}$] to produce the conductive resin substrate [SP=24.5 $(J/cm^3)^{1/2}$, volume resistivity=$2.9\times10^2$ ohm-cm], and the polyvinyl butyral was replaced with Z type polycarbonate [SP=22.1 $(J/cm^3)^{1/2}$] to produce the resin layer [SP=22.2 $(J/cm^3)^{1/2}$].

Example 4

A single layer photoreceptor according to Example 4 is identical to that produced in Example 3, except that Nylon 66 was replaced with polyethylene terephthalate resin [SP=22.3 $(J/cm^3)^{1/2}$] to produce the conductive resin substrate [SP=22.1 $(J/cm^3)^{1/2}$, volume resistivity=$2.5\times10^2$ ohm-cm].

Example 5

A single layer photoreceptor according to Example 5 is identical to that produced in Example 4, except that the polyvinyl butyral and polyethylene terephthalate resin were replaced with polystyrene [SP=19.9 $(J/cm^3)^{1/2}$] to produce the photoconductive layer [resin layer: SP=19.8 $(J/cm^3)^{1/2}$].

Example 6

A single layer photoreceptor according to Example 6 is identical to that produced in Example 3, except that only 50 parts by weight of Nylon 66 were used instead of 100 parts by weight, and 50 parts by polymethyl methacrylate [SP=19.9 $(J/cm^3)^{1/2}$] were added thereto to produce the conductive resin substrate [SP=19.8 $(J/cm^3)^{1/2}$, volume resistivity=$3.2\times10^2$ ohm-cm].

Comparative Example 1

A single layer photoreceptor according to Comparative Example 1 is identical to that produced in Example 1, except that the polyvinyl butyral was replaced with 100 parts by weight of polystyrene [SP=19.9 $(J/cm^3)^{1/2}$] to produce the photoconductive layer [resin layer: SP=19.8 $(J/cm^3)^{1/2}$].

Comparative Example 2

A single layer photoreceptor according to Comparative Example 2 is identical to that produced in Example 1, except that the Nylon 66 was replaced with polytetrafluoroethylene [SP=13.2 $(J/cm^3)^{1/2}$] to produce the conductive resin substrate [SP=13.6 $(J/cm^3)^{1/2}$].

Example 7

A conductive resin substrate was produced to be identical with that of Example 1. Next, 1 part by weight of Y type titanyl phthalocyanine as a pigment was added to 39 parts by weight of ethylcellosolve as a dispersing agent, and were dispersed using a ultrasonic disperser. To this dispersed liquid was added 1 part by weight of polyvinyl butyral as a binding resin [SP=24.2 $(J/cm^3)^{1/2}$] dissolved in 9 parts by weight of ethylcellosolve. An ultrasonic disperser was again used to disperse this mixture, and a liquid resin for forming a charge generating layer in a laminated photosensitive layer was produced. Next, this liquid resin was applied to the top of the conductive resin substrate and dried for 4 minutes at 110 degrees centigrade, thereby forming a charge generating layer [SP=24.3 $(J/cm^3)^{1/2}$] having a thickness of 0.5 microns, and producing an intermediate layer in the electrophotographic photoreceptor.

After this, 5 parts by weight of 3,3"5,5"-tetra-tert-4,4"-diphenylquinone as an electron transport agent, 8 parts by weight of N,N,N",N"-tetrakis (3-methylphenyl)-1,3-diaminobenzene as a hole transport agent, and 95 parts by weight of Z type polycarbonate and 5 parts by weight of polyester as binding agents were mixed together with 8 parts by weight tetrahydrofuran and dispersed, and a liquid resin for a charge transport layer was obtained. The liquid resin was then applied to the top of the charge generating layer, dried at 110 degrees centigrade for 25 minutes, thereby forming a charge transport layer with a thickness of 30 microns, and producing a laminated electrophotographic photoreceptor.

Example 8

A conductive resin substrate identical with that of Example 2 was produced, and a laminated photoreceptor using this conductive resin substrate was produced in a manner identical with that described in Example 7.

Example 9

A conductive resin substrate identical with that of Example 3 was produced, and a laminated photoreceptor using this conductive resin substrate was produced in a manner identical with that described in Example 7, except that the polyvinyl butyral was replaced with Z type polycarbonate [SP=22.1 $(J/cm^3)^{1/2}$] to produce the charge generating layer [SP=22.2 $(J/cm^3)^{1/2}$], and the Z type polycarbonate was replaced with polyvinyl butyral to produce the charge transport layer.

Example 10

A conductive resin substrate identical with that of Example 4 was produced, and a laminated photoreceptor using this conductive resin substrate was produced in a manner identical with that described in Example 9.

Comparative Example 3

A laminated photoreceptor was produced identical with that of Example 7, except that the polyvinyl butyral was replaced with 100 parts by weight of polystyrene [SP=19.9 $(J/cm^3)^{1/2}$] to produce the photoconductive layer [resin layer: SP=19.8 $(J/cm^3)^{1/2}$].

Comparative Example 4

A laminated photoreceptor identical with that of Example 7 was produced, except that the Nylon 66 was replaced with methyl methacrylate [SP=19.4 $(J/cm^3)^{1/2}$] to produce the conductive resin substrate [SP=19.2 $(J/cm^3)^{1/2}$, volume resistivity=$3.0\times10^2$ ohm-cm].

Example 11

A conductive resin substrate [SP=19.3 $(J/cm^3)^{1/2}$, volume resistivity=$3.1\times10^2$ ohm-cm] was produced in which 100 parts by weight of polymethyl methacrylate [SP=19.4 $(J/cm^3)^{1/2}$] was used instead of the same amount of Nylon 66.

Next, 60 parts by weight of phenol resin [SP=17.0 $(J/cm^3)^{1/2}$] as a binding agent, 15 parts by weight of carbon black (particle diameter 30 nm), 10 parts by weight of titanium oxide (particle diameter 2 microns), and 100 parts by weight of methanol as a dispersion agent were mixed together and dispersed in a ball mill for 24 hours, and a liquid resin for an intermediate layer was produced. Next, the conductive resin substrate was stood on its end, the hole on the bottom thereof was sealed from inside the tube, and the substrate was then dipped as is in the liquid resin. This applied the liquid resin to the top of the conductive resin substrate. The conductive resin substrate was then dried at 150 degrees centigrade for 25 minutes, thereby forming an intermediate layer [resin layer: SP=17.2 $(J/cm^3)^{1/2}$] with a thickness of 10 microns, and producing an intermediate substrate on the electrophotographic photoreceptor.

After this, a charge generating layer and a charge transport layer identical with those of Example 7 were respectively laminated on top of the intermediate layer, and a laminated photoreceptor was produced.

Comparative Example 5

A laminated photoreceptor was produced that was identical with that of Example 11, except that a conductive resin substrate [SP=13.6 $(J/cm^3)^{1/2}$] was produced in which polytetrafluoroethylene [SP=13.2 $(J/cm^3)^{1/2}$] was used instead of Nylon 66.

Measuring the Thickness of the Resin Layer

The difference in the thicknesses of the resin layer of the electrophotographic photoreceptor produced in the examples and the comparative examples were measured by the following method.

A contact type of film thickness measurement device was used to measure the thickness of the resin layers. First, 36 measurements were taken around the circumference of the substrate (three measurements of the same point at 30 degree intervals×12 points) at a position 20 mm from each end thereof, and an average value was determined. Next, the average value was determined in the same manner described above for the intermediate substrate of a single layer photoreceptor or a laminated photoreceptor. The film thickness was determined from the difference in these two average values. Then, the difference between the average film thickness and the film thicknesses 20 mm from the ends of the substrate were calculated, thereby indicating whether there are any differences in film thickness on the substrate.

In addition, the presence of any delamination of the resin layer was determined visually, and assigned to one of the following three categories:

⊙: No delamination seen o: A portion of the resin layer is delaminated

×: The resin layer is severely delaminated

Image Evaluation

Each example and comparative example of the electrophotographic photoreceptors was loaded into an electrostatic copying machine (a modified KM-1530 produced by Kyocera Mita). 10 pages were continuously copied, and the image on the $10^{th}$ page was evaluated for any image irregularities and assigned to one of the following four categories:

⊙: No image irregularities o: Insignificant image irregularities were produced, and only noticeable if one checked carefully for them Δ: A few image irregularities were produced ×: Considerable number of image irregularities were produced The results of the aforementioned evaluations of resin layer delamination, difference in film thickness, and irregularities in image density are shown in Table 2.

TABLE 2

| | Difference in solubility parameters $(J/cm^3)^{1/2}$ | | Resin layer | Difference in | Image |
|---|---|---|---|---|---|
| | A | B | delamination | film thickness | irregularities |
| Example 1 | 2.4 | 2.5 | ○ | 2.0 | ○ |
| Example 2 | 1.9 | 2.0 | ○ | 1.8 | ○ |
| Example 3 | 2.3 | 2.2 | ○ | 1.8 | ○ |
| Example 4 | 0.1 | 0.2 | ○ | 1.3 | ○ |
| Example 5 | 2.3 | 2.4 | ○ | 2.3 | ⊙ |
| Example 6 | 2.4 | 2.2 | ○ | 2.4 | ⊙ |
| Comparative Example 1 | 6.8 | 6.6 | Δ | 4.0 | Δ |
| Comparative Example 2 | 10.5 | 10.9 | X | 6.5 | — |
| Example 7 | 2.4 | 2.3 | ○ | 0.05 | ○ |
| Example 8 | 1.7 | 1.9 | ○ | 0.03 | ○ |
| Example 9 | 2.3 | 2.2 | ○ | 0.04 | ○ |
| Example 10 | 0 | 0.1 | ○ | 0.03 | ○ |
| Comparative Example 3 | 6.8 | 6.6 | Δ | 0.11 | Δ |
| Comparative Example 4 | 5.1 | 4.8 | Δ | 0.09 | X |
| Example 11 | 2.1 | 2.4 | ○ | 0.08 | ○ |
| Comparative Example 5 | 3.6 | 3.8 | Δ | 2.0 | Δ |

In Table 2, column A shows the differences between the solubility parameter of the resin layer and the solubility parameter of the conductive resin substrate, and column B shows the differences between the solubility parameter of the binding resin in the resin layer and the solubility parameter of the conductive resin substrate. In addition, the solubility parameters of the binding resins were calculated with a weighted average.

As shown in Table 2, the single layer photoreceptors of Examples 1 to 6 have no delamination or crystallization in their resin layers, and a small difference in film thickness compared to the single layer photoreceptors of Comparative Examples 1 and 2. Because of this, an excellent image having no density irregularities can be obtained during image formation. On the other hand, some delamination was seen with the resin layer on the photoreceptor of Comparative Example 1. In addition, density irregularities were produced during image formation. Considerable delamination was seen with the resin layer on the photoreceptor of Comparative Example 2, and an image could therefore not be formed.

The laminated photoreceptors of Examples 7 to 10 have no delamination or crystallization in their resin layers, and only small differences in film thickness compared to the laminated photoreceptors of Comparative Examples 3 and 4. Because of this, an excellent image having no density irregularities can be obtained during image formation. On the other hand, some delamination was seen with the resin layers on the photoreceptors of Comparative Examples 3 and 4. In addition, density irregularities were produced during image formation.

The intermediate layer of Example 11 provided on a photoreceptor had no delamination or crystallization in its resin layer, and only a small difference in film thickness compared to the intermediate layer of Comparative Example 5. Because of this, an excellent image having no density irregularities can be obtained during image formation. On the other hand, some delamination was seen with the resin layer on the photoreceptor of Comparative Example 5. In addition, density irregularities were produced during image formation.

The terms of degree used herein such as "about" and "approximately" mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An electrophotographic photoreceptor, comprising:

a conductive resin substrate; and a resin layer comprised of a binding resin and formed on the conductive resin substrate;

wherein a difference between a solubility parameter of the conductive resin substrate and the solubility parameter of the resin layer is 2.5 $(J/cm^3)^{1/2}$ or less; and the conductive resin substrate is comprised of a resin that is chemically different from the resin comprising the resin layer.

2. An electrophotographic photoreceptor as set forth in claim 1, wherein the conductive resin substrate comprises one or more resins selected from a group consisting of a polyamide resin, a polyvinyl butyral resin, and a polyester resin.

3. An electrophotographic photoreceptor as set forth in claim 1, wherein the conductive resin substrate has a solubility parameter of 22 $(J/cm^3)^{1/2}$ or greater.

4. An electrophotographic photoreceptor as set forth in claim 1, wherein a volume resistivity of the conductive resin substrate is between approximately $10^{-3}$ and $10^{10}$ Ω-cm.

5. An electrophotographic photoreceptor as set forth in claim 1, wherein the resin layer comprises one or more resins selected from a group consisting of a polycarbonate resin, a polyamide resin, a polyvinyl butyral resin, and a polyester resin.

6. An electrophotographic photoreceptor as set forth in claim 1, wherein the resin layer further comprises a charge generating agent and/or a charge transport agent.

7. An electrophotographic photoreceptor as set forth in claim 1, wherein the resin layer further comprises a pigment.

8. An electrophotographic photoreceptor as set forth in claim 1, wherein the conductive resin substrate includes a conductive filler.

9. An image forming device, comprising:

the electrophotographic photoreceptor as set forth in claim 1;

a drive means that drives the electrophotographic photoreceptor in a fixed direction; and an image forming unit disposed around the electrophotographic photoreceptor.

10. An electrophotographic photoreceptor, comprising:

a conductive resin substrate comprising one or more resins selected from a first group consisting of a polyamide resin, a polyvinyl butyral resin, and a polyester resin; and a resin layer comprising one or more resins selected from a second group consisting of a polycarbonate resin, a polyamide resin, a polyvinyl butyral resin, and a polyester resin and formed on the conductive resin substrate;

wherein a difference between a solubility parameter of the resin selected from the first group and a solubility parameter of the resin selected from the second group is 2.5 $(J/cm^3)^{1/2}$ or less; and the conductive resin substrate is comprised of a resin that is chemically different from the resin comprising the resin layer.

11. An electrophotographic photoreceptor as set forth in claim 10, wherein the resin selected from the first group has a solubility parameter of 22 $(J/cm^3)^{1/2}$ or greater.

12. An electrophotographic photoreceptor as set forth in claim 10, wherein a volume resistivity of the conductive resin substrate is between approximately $10^{-3}$ and $10^{10}$ Ω-cm.

13. An electrophotographic photoreceptor as set forth in claim 10, wherein the resin layer further comprises a charge generating agent and/or a charge transport agent.

14. An electrophotographic photoreceptor as set forth in claim 10, wherein the resin layer further comprises a pigment.

15. An electrophotographic photoreceptor as set forth in claim 10, wherein the conductive resin substrate includes a conductive filler.

16. An image forming device, comprising:

the electrophotographic photoreceptor disclosed in claim 10; and a drive means that drives the electrophotographic photoreceptor in a fixed direction; and an image forming unit disposed around the electrophotographic photoreceptor.

* * * * *